US008215405B1

(12) United States Patent
Carrascal

(10) Patent No.: US 8,215,405 B1
(45) Date of Patent: Jul. 10, 2012

(54) METHOD TO SHUT DOWN A HIGH PRESSURE OIL/GAS WELL THAT IS LEAKING UNDER BLOWOUT CONDITIONS

(76) Inventor: Jorge Fernando Carrascal, Hoffman Estates, IL (US)

( * ) Notice: Subject to any disclaimer, the term of this patent is extended or adjusted under 35 U.S.C. 154(b) by 15 days.

(21) Appl. No.: 13/113,208

(22) Filed: May 23, 2011

Related U.S. Application Data

(63) Continuation-in-part of application No. 13/046,416, filed on Mar. 11, 2011, now abandoned.

(51) Int. Cl.
*E21B 23/00* (2006.01)
*E21B 33/00* (2006.01)

(52) U.S. Cl. ..... 166/363; 166/351; 166/364; 166/285; 166/77.1; 166/193

(58) Field of Classification Search ..... 166/368, 166/339, 340, 350–352, 359, 363, 364, 284, 166/285, 290, 295, 297, 300, 268, 387, 55.1, 166/77.1, 75.15, 192, 193; 175/65, 72, 5; 405/57, 233, 240, 256, 257, 267
See application file for complete search history.

(56) References Cited

U.S. PATENT DOCUMENTS 1,563,520 A * 12/1925 Owen ..... 166/285
1,631,419 A * 6/1927 Kinley ..... 166/63
2,743,779 A * 5/1956 Brown ..... 166/290
3,161,235 A * 12/1964 Carr ..... 166/281
3,208,525 A * 9/1965 Caldwell et al. ..... 166/295
3,463,230 A * 8/1969 Dodson ..... 166/250.02
3,603,398 A * 9/1971 Hutchison et al. ..... 166/305.1
3,638,730 A * 2/1972 Smith ..... 166/291
3,647,000 A * 3/1972 Rowley et al. ..... 166/285
3,738,424 A * 6/1973 Osmun et al. ..... 166/298
3,926,256 A * 12/1975 McCall ..... 166/285
4,195,690 A * 4/1980 Erbstoesser et al. ..... 166/281
4,275,788 A * 6/1981 Sweatman ..... 166/292
4,324,505 A * 4/1982 Hammett ..... 405/60
4,369,845 A * 1/1983 Henson et al. ..... 166/298
4,372,378 A * 2/1983 Powers, Jr. ..... 166/57
4,382,716 A * 5/1983 Miller ..... 405/60
4,417,625 A * 11/1983 Henson et al. ..... 166/387
4,568,220 A * 2/1986 Hickey ..... 405/60
4,972,906 A * 11/1990 McDaniel ..... 166/276
5,472,052 A * 12/1995 Head ..... 166/298
5,485,882 A * 1/1996 Bailey et al. ..... 166/284
6,474,414 B1 * 11/2002 Gonzalez et al. ..... 166/277
6,595,289 B2 * 7/2003 Tumlin et al. ..... 166/286
6,923,263 B2 * 8/2005 Eden et al. ..... 166/288
7,380,603 B2 * 6/2008 Jeffrey et al. ..... 166/285
7,527,095 B2 * 5/2009 Bloess et al. ..... 166/265
2011/0056697 A1 * 3/2011 Calderoni et al. ..... 166/363

* cited by examiner

*Primary Examiner* — Matthew Buck

(57) ABSTRACT

Year 2010 showed us that the oil/gas industry was not prepared to shut down in few days a high pressure oil/gas well. The Gulf of Mexico was polluted by thousands of barrels of oil that were leaking from a high pressure well. The environment damage was humongous as well as the economical loses. Here, I am presenting a method to shut down a high pressure oil/gas well in matter of days rather than in months. This method keeps the well integrity. This method is effective even if the well integrity was compromised.

5 Claims, 11 Drawing Sheets

METHOD TO SHUT DOWN A HIGH PRESSURE OIL/GAS WELL THAT IS LEAKING UNDER BLOWOUT CONDITIONS

CROSS-REFERENCE TO RELATED APPLICATIONS

This application is a continuation in part of my previous application Ser. No. 13/046,416 filed on Mar. 11, 2011 now abandoned

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Petroleum engineering is a field specialized in the search, development and exploitation of reservoirs of hydrocarbons. In this endeavor, companies have extended their exploration from land to lakes, and the ocean. Year 2010, marked an environment and economic disaster never seen in the history of the United States of America. British Petroleum was drilling in deep waters in the Gulf of Mexico. Due to a set of wrong human decisions and a mechanical failure, the world was seen how a high pressure oil/gas well was pouring thousands of barrels of oil into the ocean for several months. So far, there is not any method of technology that has been invented in order to shut down a high pressure oil/gas well in few days, rather than in months.

The closest attempt to shut down an oil well like Macondo in the Gulf of Mexico in year 2010 is placing a second set of blow out preventers "BOP's" on the top of the ones that failed, and trying to close them; the imminent risk is that the casing could fail due to the high downhole pressure, yielding to a fracture that could extend the leak to the ocean floor. So, the well integrity is compromised.

So far, the oil/gas industry does not have a way to stop an oil/gas leak from a well in a short period of time. The only safe way to do that is to drill one or two lateral wells to intercept the one that is leaking. This operation could take several months before it is done. In addition, it brings all the risks associated with drilling. My method for the problem is to use a grid to build a downhole filter in the well. Once the filter has been set, it is easier to plug it and kill it off.

SUMMARY OF THE INVENTION

An oil/gas well could be leaking due to different reasons. Among others are: Unexpected natural conditions, human errors, bad cementation jobs, the well integrity was compromised, or mechanical failures.

Depending of the nature of the leak, there are only a couple of methods that could be used to stop it. Assuming that the blow out preventers are working, we can close them. However, if the downhole pressure is much greater than the burst pressure of the casing, it could fail. In this case, this approach will compromise the well integrity. Oil/gas can start to leak through the floor. A second method to stop the oil/gas leak is to drill a relief well that will intercept the one that leaking.

This operation could take several months. This brings as a consequence an enormous environmental damage and great economic loss.

My method consists of setting a grid at any depth in order to start the process of shutting down the oil/gas well. The grid could be initially used to catch some matrix material to build a filter. Once the filter is built, we can deploy plugging material to plug it.

In conjunction with the grid, we can use only impermeable material to plug the well. It is the easiest and fastest way. However, it is not advisable. The reason is that the well could be plugged prematurely bringing bad consequences for the well such as compromising the well integrity.

When the grid is set, the downhole pressure is not trapped 100% because oil and gas can continue coming out of the hole. In this way, we can keep the well integrity.

This method is good even in the case that oil/gas may be leaking through the ocean floor due that well integrity was compromised. By using my method, plugging the well will take only few days as long as all the required material and the plan are ready.

DETAILED DESCRIPTION OF THE INVENTION

In order to shut down a high pressure oil/gas well that is leaking in a lake, or in the ocean, we need at least a servicing string of pipe, a grid, and some plugging material.

For this discussion, let's assume that we are using regular pipe rather than coiled tubing. If we are using regular pipe, there is a problem we have to solve. How can we make the pipe? We know that once the string of pipe enters into the wellhead, the fluids that are coming out the oil/gas well will enter into the pipe. They will travel up to surface vessel where the drilling crew is assembling the joints. It will be impossible to make the pipe due that the oil will wet the rig floor. There is also a lot of gas that will travel to the surface. There are many engines running in the vessel. Therefore there is a risk for a big explosion.

To overcome this problem, before the servicing string of pipe enters in to the wellhead, we have to incorporate a valve, a perforated joint, and a sliding sleeve into the servicing string of pipe. The valve can be a one way valve. If it gives problems for slickline operations to be executed, we can use a ball valve, or any valve that will restrict the flow of fluids to the surface. If we use a ball valve, we can close it or open it using a Remote Operate Vehicle, ROV. So, by using a valve, we stop the flow of fluids to the surface.

Figure 1:
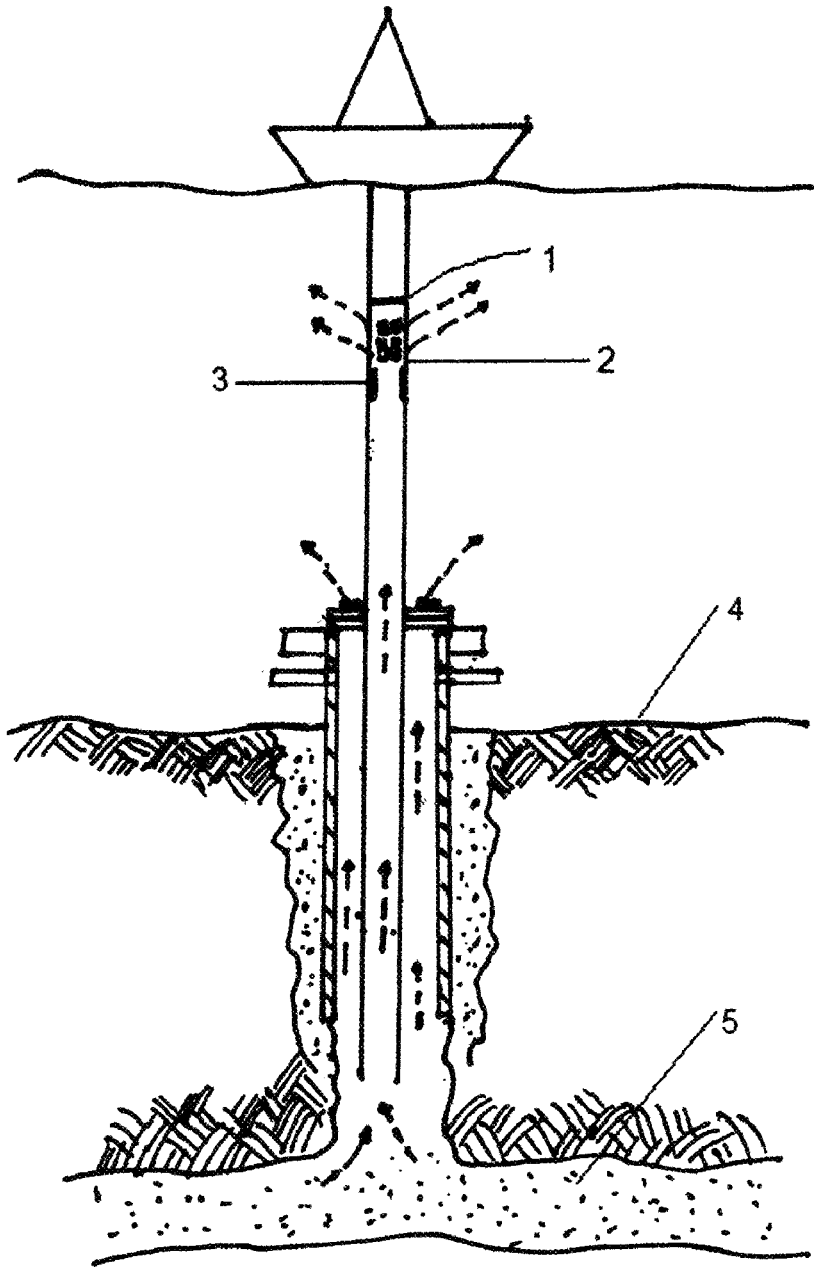
FIG. 1 is an elevational view of the full well and a surface vessel. A valve is in closed position. The sliding sleeve is in open position. Fluids are coming out of the perforated joint and through the grid that is in the wellhead.

If the valve is in closed position, the pressure from the downhole fluids will try pushing the servicing string of pipe out of the hole. To overcome this problem, we have the perforated pipe underneath the valve. In this way, the fluids will come out through the perforated pipe. We can see these tools in operation in FIG. 1. Where the valve 1 is in closed position, the fluids that are coming out from the well are going out to the ocean through the perforated joint 2. We use the sliding sleeve 3 to open or close the holes in the perforated joint. The sliding sleeve 3 is in open position. For better functionality we should have a sliding sleeve that can be moved to open or close position with tools that are run inside of the pipe. In this context, 4 is the ocean floor, and 5 is the pay zone.

Now, before we enter the wellhead, we have to open the valve and close the holes in the perforated pipe. So, we can use the sliding sleeve. We move the sliding sleeve to close the section of holes in the perforated pipe. The sliding sleeve can be moved using slickline or any other appropriated means. In the worst case scenario, we can use a sliding sleeve that can be moved to open or close position from outside using Remote Operated Vehicles, ROVs.

Before the section of the Bottom Hole Assembly, BHA, that has the valve, the perforated joint and the sliding sleeve enters in to the wellhead, the valve should be in open position, and the sliding sleeve should be in closed position.

We repeat this operation of placing valves, perforated joints and sliding sleeves as we may need in order to assemble the desired length of pipe that is run into the hole.

Now that we have solved the problem of how to run the servicing string of pipe into the hole, let's talk about how we can start the process of shutting down the oil/gas well.

We can place a grid system somewhere downhole, in the wellhead, or outside the wellhead. I will discuss here only the first two options just to demonstrate how the system works. Also, it is better to use the grid to build a filter, rather than using it to catch just plugging material. Once the filter is built, it is easier to plug the well.

1. Placing a Grid Somewhere Downhole

In order to know at what depth we should place the grid that is integrated in the servicing string of pipe, we should calculate the length of the filter. The planned length for the filter should be calculated using the assumed downhole pressure. If we have some additional pressure, like pumping we can also place it here. The core of this matter is to have a filter weight that will at least balance the expected downhole force, according to the expected situation in hand. So, let's use this equation:

$$l = \frac{p}{0.052 * \delta} \text{ where:}$$

$l$ is the minimum length of the filter in feet, $p$ is the downhole pressure in psi;

and δ is the density of the material that is forming the matrix in pounds per gallon. The bottom of the servicing string of pipe can be placed at certain depth close to the formation that contains hydrocarbons. For instance it could be 3 feet from above the pay zone. Or if we can, it could be 2 feet above the bottom of the well. The grid should be strong enough to hold any material that may be coming out of the hole. For example it may be something like three concentric pipes of certain length that are connected by strong welding. The length of the pipe could be like 3 feet. It is up to engineering to design the grid.

Figure 2:
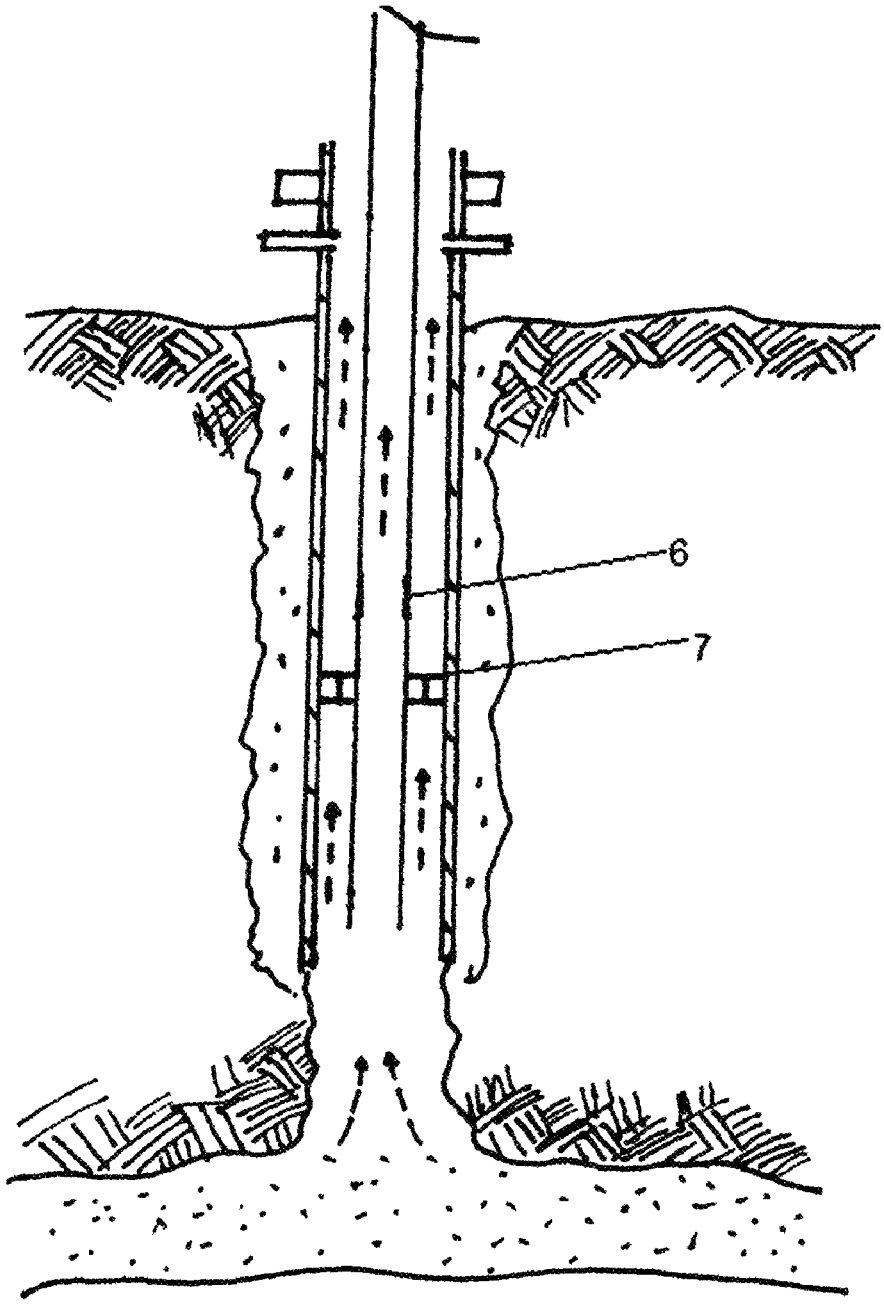
FIG. 2 is an elevational view of an oil/gas well where we can see a grid that is integrated in the servicing string of pipe. Above the grid there is a detachable joint. Fluids are coming out of the hole from the annular side and from the servicing string of pipe.

Above the grid, we can have a detachable joint. See FIG. 2, where there is a detachable joint 6 above the integrated grid 7 on the servicing string of pipe. The reason to use a detachable joint is that once we have plugged the lower portion of the well, we can detach the servicing string of pipe, start pumping cement, and plug the upper portion of the well. Let's see how we can set a downhole filter and how we can plug it.

Once we have the minimum length for the filter, and we have decided the depth of the bottom of the service string of pipe, we are ready to start to deploy the material that will make the matrix. In addition to the length of the matrix we can have and extra joint. The length of the matrix can be calculated using the maximum pumping expected pressure. First, we can pump through the servicing string of pipe a batch polymer balls. After this batch of polymer balls, we can pump the matrix component for the filter. We can use any material, or combination of materials for the matrix, with any geometrical shape. Even, we can use a combination of geometrical shapes. However, it is better to use balls.

A good material could be nonmagnetic steel balls. We also could use ceramic balls. Or, we could use a combination of different materials with different geometries. It is better to use balls because they offer a good resistance to be lifted by the downhole fluids. In addition, with balls forming the matrix, the flow of fluids is more predictable and stable. If we use as a matrix any other geometry different than balls, care should be taken to avoid plugging the well prematurely. If that happens, the plug can be pushed out of the hole due to the high downhole pressure. By doing this, a dangerous situation is created. The servicing string of pipe may start to come out of the hole. People in the surface vessel may be hurt, and the operation will be ruined. In the best case scenario, the servicing string of pipe could be buckled in the hole. A gel fluid can help to space the matrix material while it is pumped.

So, for better practice, we should use balls. The bails can have a diameter close to the inside diameter of the servicing string of pipe. If the balls are about half of the diameter of the servicing string of pipe, it is quite likely that they will jam the pipe. Also, if we want to use smaller balls, we can do it, but we have to make sure they will not jam the servicing string of pipe.

Figure 3:
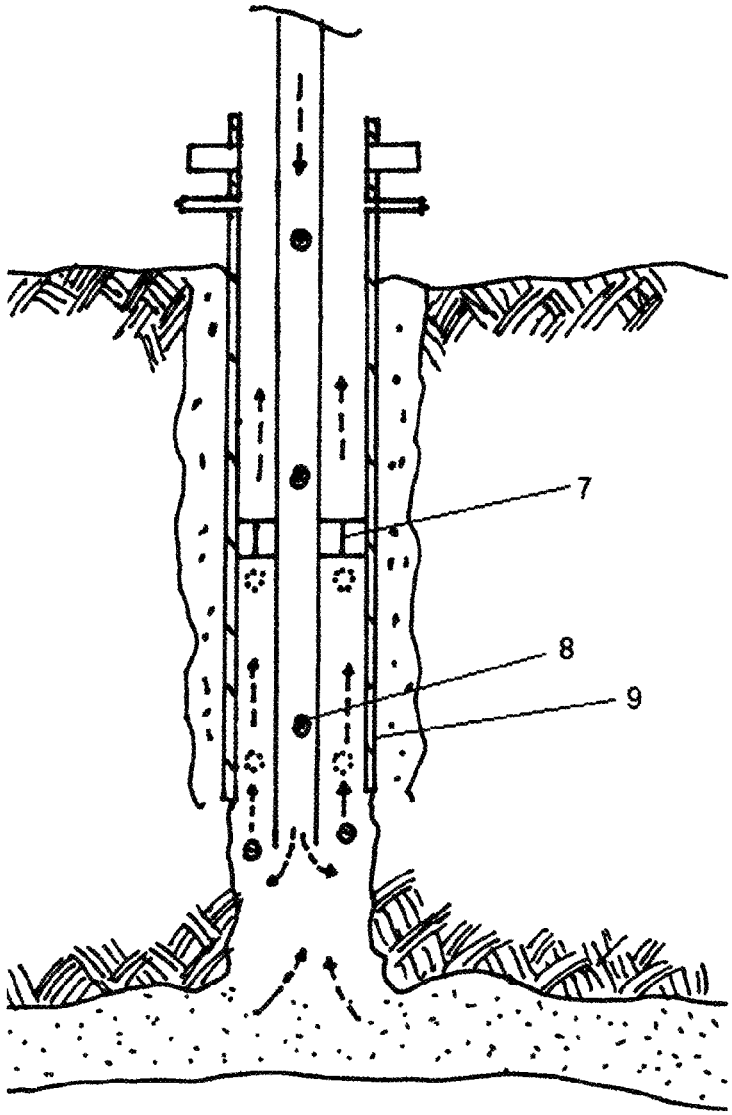
FIG. 3 is an elevational view of an oil/gas well displaying how some balls are being deployed in to the well. Once they arrive to the bottom of the servicing string of pipe, they are pushed out through the annular side by the fluids that are coming out of the well. The balls are trapped by a grid that is integrated in the servicing string of pipe.

Now that the location of the filter has been determined, and that we have decided to use balls to form a matrix for the filter, we can start to deploy the balls into the hole. We start by pumping the balls through the servicing string of pipe. Once the balls reach the bottom of the servicing string of pipe, they will travel through the annular space between the servicing string of pipe, and the casing and/or the open hole. See FIG. 3. Where the downhole grid 7 is catching the matrix components 8. A sectional cut of the casing 9 is being displayed. Due to the high pressure, these balls will try to go out at high speed. Because we pumped first the polymer balls; they will serve as a cushion for these new balls. In this way, the grid that is in the servicing string of pipe will have a reduced hammered effect. Another way is to have some rubber inserted in the grid. So, there is no need to pump polymer balls. Because steel has a high density, as they accumulate, their weight will try to take them to the bottom. As we deploy the balls to build the filter in the annular side of the servicing string of pipe, we can see in the surface vessel if the servicing string of pipe is been pushed out by the downhole pressure and by what force. If the force is getting too big, we should abort this operation. To abort the operation, we start to pull out the servicing string of pipe slowly; to avoid plunger effect and to avoid making the situation worse in the surface vessel. Otherwise, we can continue building the filter.

There is a chance that before we reached the desired length for the filter, perhaps some balls may be floating around. In order to overcome this problem, we can change the size of the balls, or we can use balls with lower density. Also, we can pump balls with more roughness. Or even, we can change the geometry of the matrix material.

Once the desired filter is build built, we have different options to plug the well. I am going to describe some.

(a) We can pump a volume of synthetic sorbents that swells with oil. A good initial volume to be pumped could be equivalent to the volume of the porous space in the matrix of the filter plus the volume of the casing and/or open hole from the bottom of the matrix to the bottom of the hole. We may need to pump some excess of this material because some of this material may be able to travel above the grid leaving the filter due to the high downhole pressure. For this reason, it is recommended to use big chunks of plugging material. It will be more difficult for these big chunks to travel through the pores tortuosity.

Figure 4:
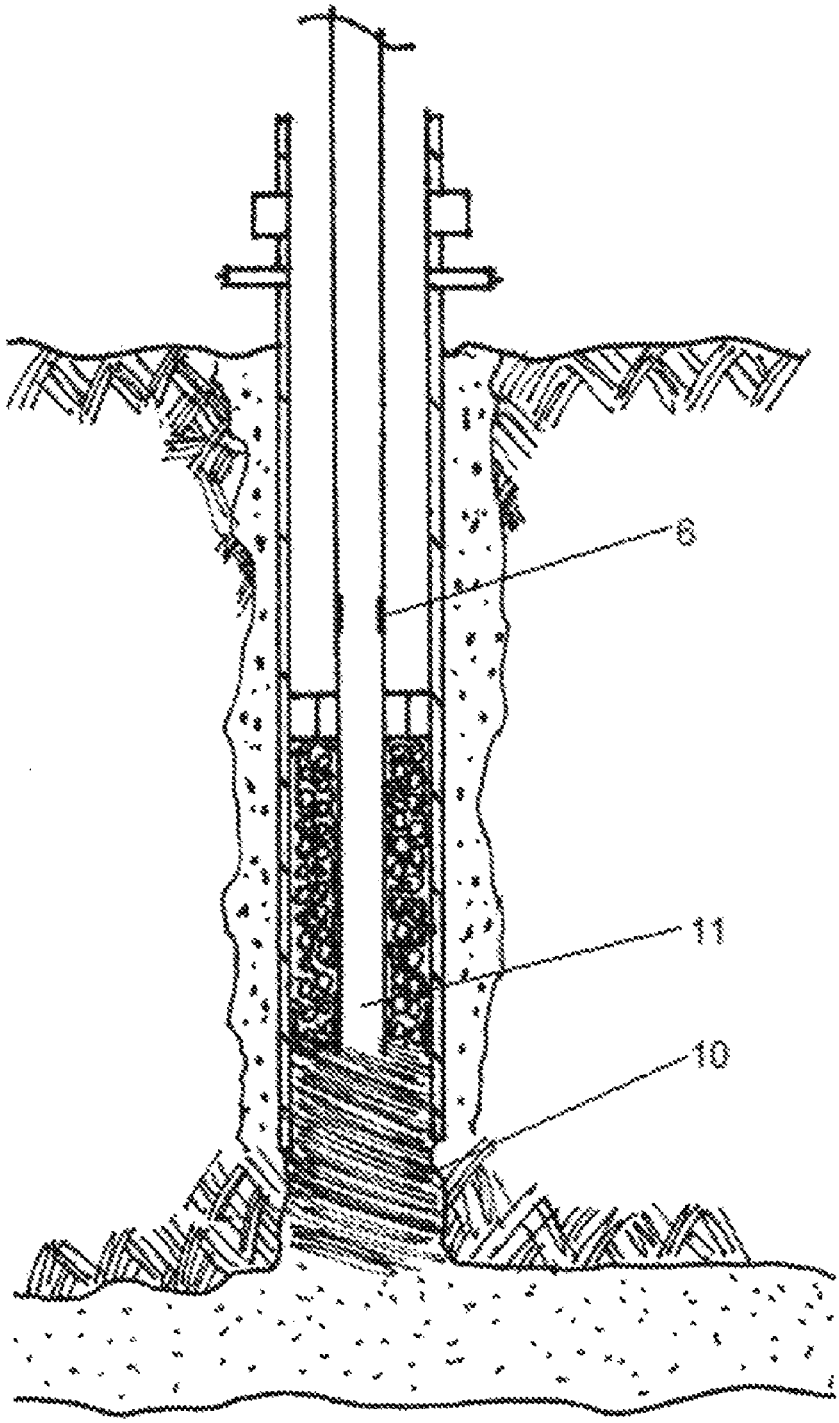
FIG. 4 is an elevational view of an oil/gas well where the bottom is being plugged by synthetic sorbents. The porous area of the matrix is also plugged with synthetic sorbents that swell in contact with oil. At the bottom of the servicing string of pipe there is a displacement fluid.

Once the displacement fluid reaches the bottom of the servicing string of pipe, we hold the surface pressure in the servicing string of pipe and wait for the synthetic sorbents to swell and plug the bottom of the hole and the porous space of filter matrix. The service string below the grid should be free of synthetic sorbents. See FIG. 4, where there is a plug of synthetic sorbents 10 underneath the servicing string of pipe. Inside the servicing string of pipe there is some displacement fluid 11. It is possible that while we wait for the synthetic sorbents to swell, gas bubbles can be traveling through the servicing string of pipe. Some distance above the grid there is a detachable joint 6 in the servicing string of pipe. The reason for this joint is that when we plug the bottom of the well, we can detach the pipe and start to plug the upper section of the well.

To avoid gas bubbles to travel up in the servicing string of pipe, or to reduce this problem, we can pump a soft rubber plug of a diameter a little be bigger than the average inside diameter of some joints of the servicing string of pipe at the end of the synthetic sorbents. We have just to make sure we are able to pump this soft plug all the way down the servicing string of pipe. After we have waited for the synthetic sorbents to swell, we have another choice to free some gas that may have been trapped in the servicing string of pipe. We open the sliding sleeve that is some distance below the vessel and close the valve above it. In this way, the trapped gases can go out. We wait some time and see if there is more flow of fluids through the perforated joint. At this point, we check if there are fluids coming out in the annular side of the hole. If no fluids are coming out of the hole, the downhole plug is working. If there are still fluids coming out of the hole, we have to pump more synthetic sorbents, we wait for them to swell and check if there are not more fluids that are coming out of the well. We repeat this operation as it may be necessary.

Figure 5:
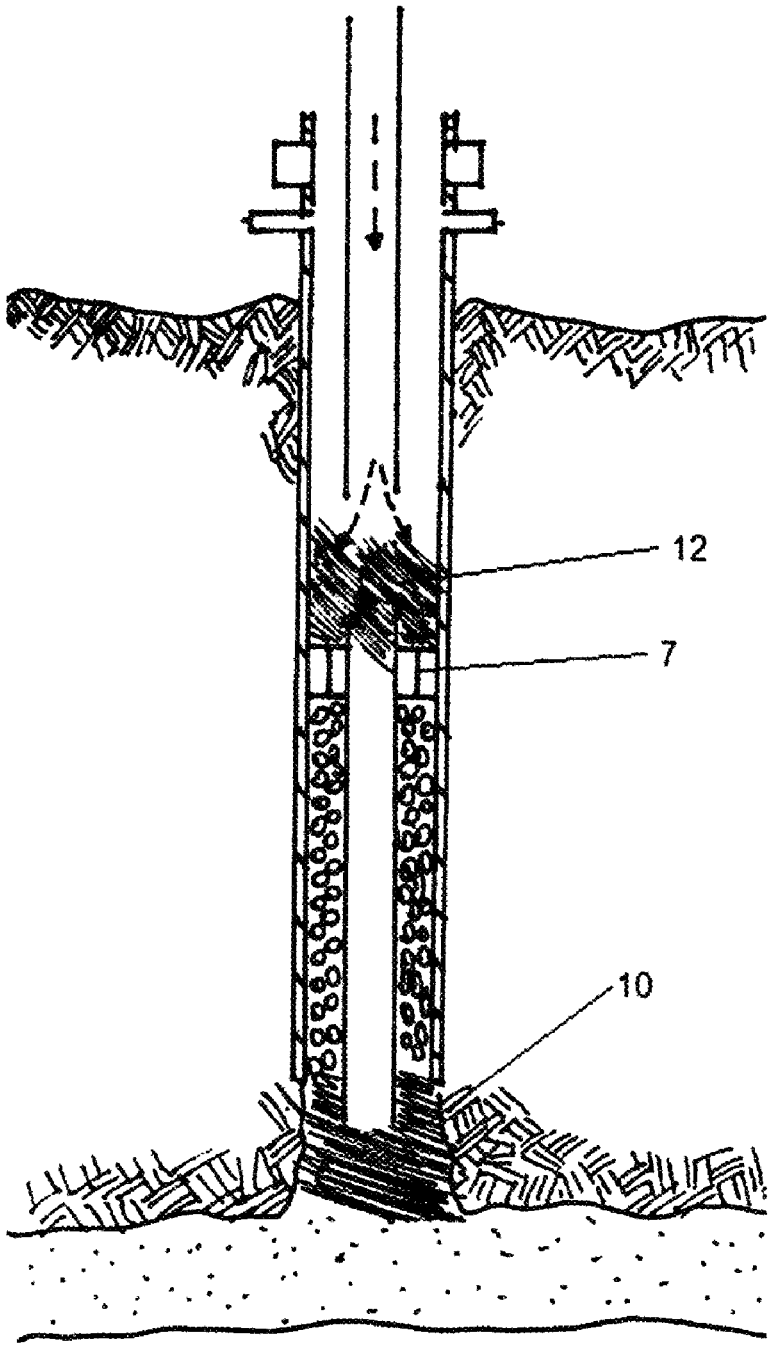
FIG. 5 is an elevational view of an oil/gas well where the bottom of the well was plugged with synthetic sorbents. As the servicing string of pipe is being pulled out, cement is being pumped.

Once there are not more fluids coming out of the well, we detach the servicing string of pipe from the detachable joint that is above the grid, and we can start to pump cement as we pull out of the hole. The amount of cement to be pumped should be the volume of the casing from the location of the grid up to the wellhead. See FIG. 5, where the bottom of the well is being plugged by synthetic sorbents 10, the integrated grid 7 helps to avoid the matrix elements of the filter to come out of the hole. Cement 12 is being pumped as the servicing string of pipe is being pulled out.

(b) For this next solution to plug the well, it is required to have in the BHA a perforated joint and a sliding sleeve near the bottom of the servicing string of pipe. As an alternative of this, we can also use a semi perforated joint which will pop out the caps at a specific differential pressure. Once the differential pressure is reached, the caps will pop out allowing the flow of fluids from inside of the servicing string of pipe to the annular side or vice versa. This semi perforated joint can substitute the perforated joint and the sliding sleeve assuming that for any reason we cannot use a tool to open or close the sliding sleeve. It is also a good choice to save time. The end of the servicing string of pipe should be near the pay zone. Also, it is necessary that the length of the filter should be much larger than the minimum length that was calculated using the equation I wrote in a previous section. The reason for this is that if we have to pump at a pressure larger that the assumed downhole pressure and if the filter is sealed from the bottom, we can start to lift the plug, and also the servicing string of pipe. This creates a dangerous situation.

We build the filter as we mentioned in the previous solution. Once the downhole filter has been set, we can pump a good batch of impermeable material followed by a good batch of cement. For instance, the impermeable material could be plastic bags. When they get into the bottom of the servicing string of pipe, they will go up through the annular side. The downhole pressure will lift them up. They will be entangled in the bottom of the matrix and they will plug the annular side of the servicing string of pipe and the casing or the open hole. So, fluids cannot go through the annular side.

Figure 6:
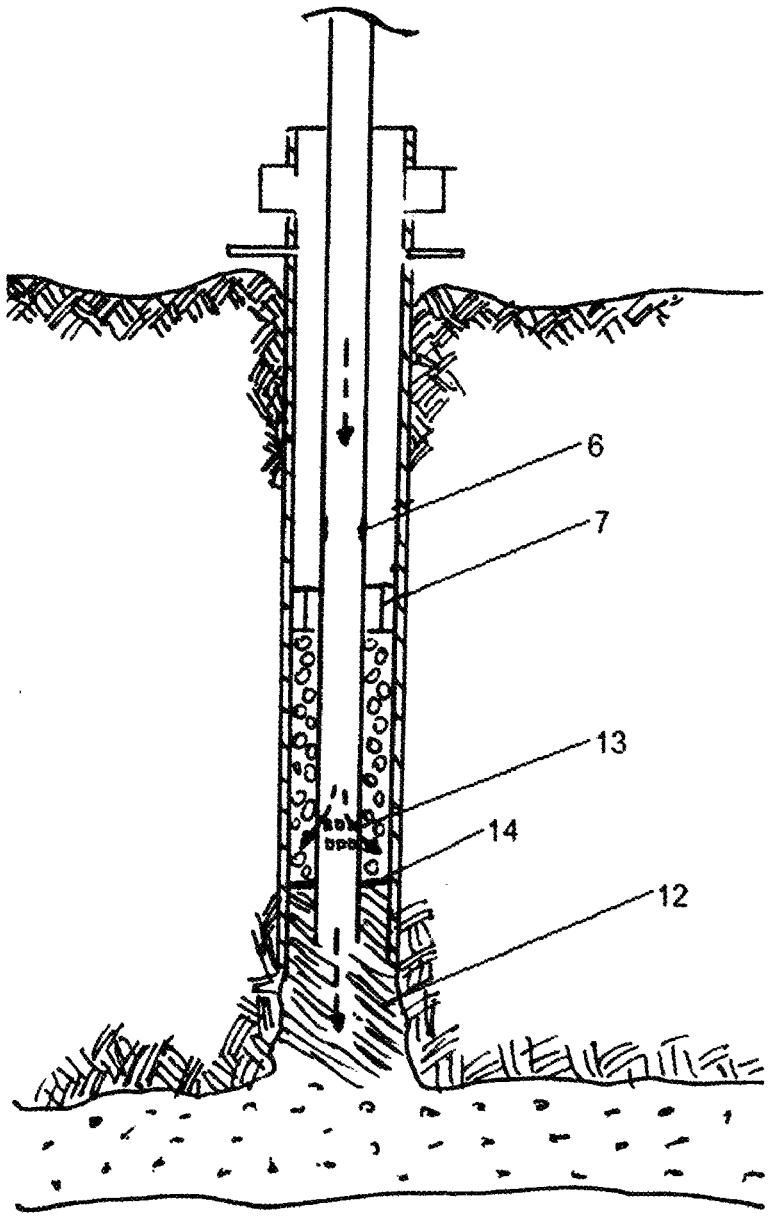
FIG. 6 is an elevational view of an oil/gas well where there is a layer of impermeable material at the bottom of the filter matrix. This layer avoids fluids to go out through the annular side. A semi perforated joint is opened due to a pressure differential. Cement is being pumped through the servicing string of pipe. The cement goes to the bottom of the well and also to the annular side of the servicing string of pipe and the casing.

As we continue pumping, the pressure in the servicing string of pipe will increase due that not fluids or little fluids are coming out of the hole from the annular side. At this stage, a differential pressure is created and at predetermined value the caps in the semi perforated joint will pop out. So, fluids can flow through the perforated pipe. Once this is done, cement will go to the annular side. We can pump enough cement to try to plug the section below the bottom of the servicing string of pipe and the porous area in the filter matrix. The pumping pressure should be lower than the fracture pressure of the formation. Once the displacement fluid reaches the grid, we hold the pressure and wait for the cement to get hard. At this stage, there will be cement inside the servicing string of pipe from some few feet below the detachable joint down to the bottom of the formation. In FIG. 6, we can see the grid 7 is containing the matrix; some cement 12 is being pumped. So, a bottom semi perforated joint 13 is allowing cement to go to the annular side. A layer of impermeable material 14 is avoiding underneath fluids to go up.

After we know that the cement is hard, we can detach the servicing string of pipe 6. Once the servicing string of pipe is detached, we can start to pump cement to fill the volume above the grid. We have to pump it by batches taking into account the hardening time for the cement, the time we take to lift the servicing string of pipe, the time to detach the joints. We pump cement as we lift the servicing string of pipe. After the well has been cemented, a cap can be placed on the wellhead. On the other hand, we can pull out the servicing string of pipe, and we can go down with coiled tubing and cement the upper section.

(c) This solution is similar to the previous one, except that after the batch of impermeable material such as plastic bags, we are pumping synthetic sorbents. The amount of these sorbents should be enough to plug the volume from the layer of impermeable material to the bottom of the well. The displacement fluid should follow. The end of the displacement fluid should be at the end of the servicing string of pipe. We wait for the synthetic sorbents to swell. We open the sliding sleeve that is near the surface vessel and close the valve. Perhaps some trapped gases may come out. We wait until there are not more fluids coming out of the well. We can start pumping enough cement to plug the porous area in the matrix of the filter. Again, as we start to pump, there will be an increase in pressure inside the servicing string of pipe. The caps in the semi perforated joint will pop out. Now, somebody can say that some of the matrix elements will avoid the caps to pop out. That may be partially true. We just have to make sure that there are enough semi perforated holes. They could be small, or they may have different sizes. In addition, some of those may open partially as a result that some matrix elements will block them, and some others will be fully open.

We wait for the cement to get hard. After the cement is hard, we detach the servicing string of pipe, we pull it out. We may come back down with coiled tubing to plug the upper section of the well.

(d) Assuming that there are multiple pay zones and that we can lower the servicing string of pipe below the lowest pay zone, we calculate the length of the filter using the equation I already provided. Again, we have to take into account that if we plug the bottom of the filter, there will be an increase in pressure as we pump. Using the same equation, we can calculate how much additional safety length we may need. In this case the pressure value is the expected increase in pressure in order to pop out the caps in the semi perforated joint.

Figure 7:
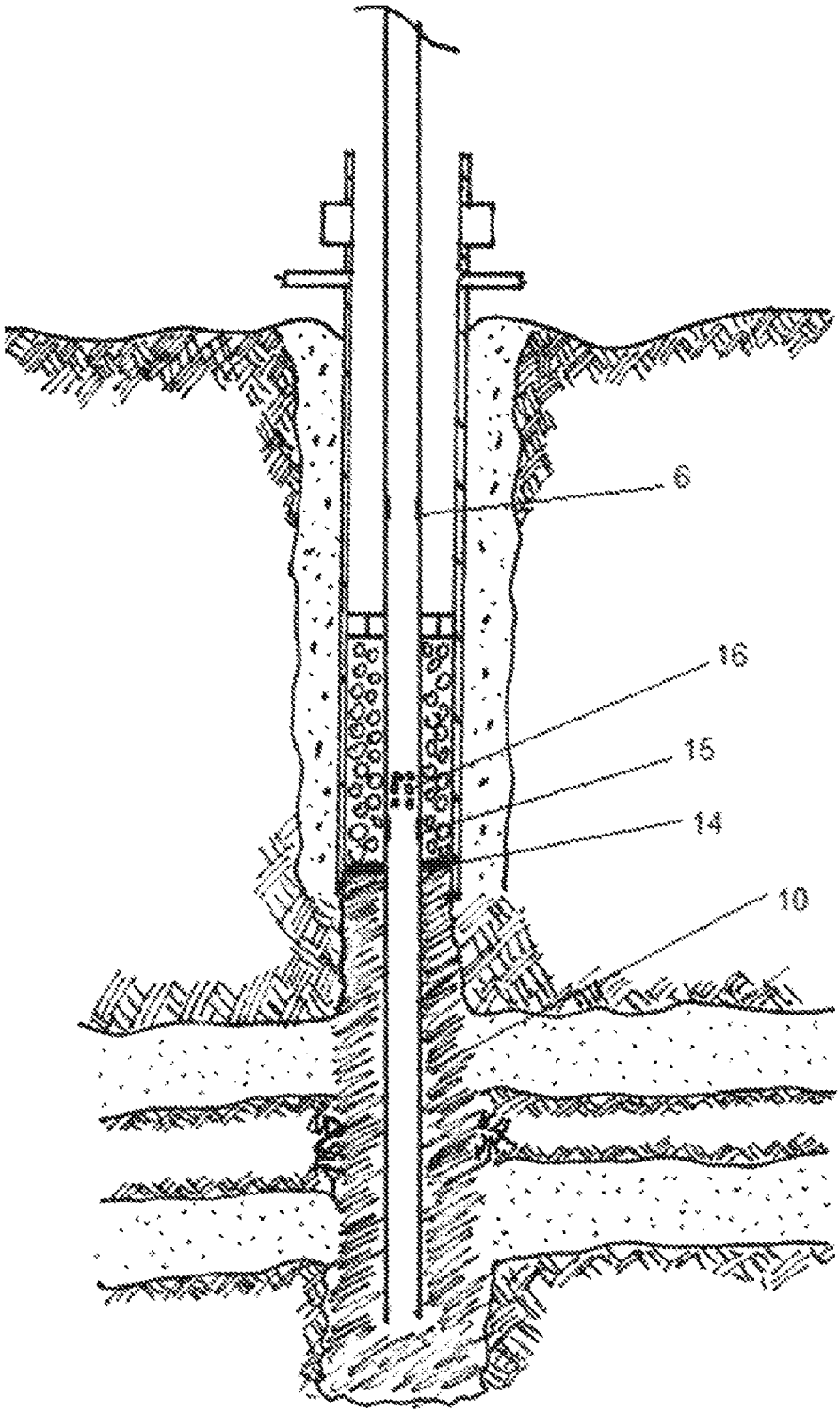
FIG. 7 is an elevational view of an oil/gas well where there are multiple pay zones that have been plugged by synthetic sorbents.

We build the filter matrix as it was mentioned before. After the matrix is built, we pump little impermeable material. We should try to avoid to fully plugging the bottom of the matrix. However, if it is plugged, it is OK. This impermeable material should be followed by a volume of synthetic sorbents to plug the annular side from the bottom of the oil/gas well to the lowest point in the filler matrix. Displacement fluid should follow. When the beginning the displacement fluid is at the end of the servicing string of pipe, we stop pumping and hold the pressure. We wait for the synthetic sorbents to swell and plug all the section from the bottom of the matrix to the bottom of the well. We check that there are not more fluids coming out of the hole. If there are, we pump more, repeating the operation until there are not more fluids coming out of the hole. When this happens, we can start to pump cement to plug the porous area in the matrix. We degas the servicing string of pipe. Later, we go down with wireline or any appropriated equipment and open the sliding sleeve that is close to the end of the servicing string of pipe. We start to pump cement to plug the porous section of the matrix. We stop pumping leaving the displacement fluid underneath the detachable joint. See FIG. 7, where the pay zones are plugged with synthetic sorbents 10. These sorbents did not go up through the matrix because en impermeable layer 14 avoids it. There is near bottom sliding sleeve 15 and a perforated joint 16 above the place where the layer of impermeable matrix is located. Above the integrated grid there is a detachable joint 6.

Once this is done, we detach the servicing string of pipe from the joint that is above the grid. We pull out the servicing string of pipe. We come back down with coiled tubing and plug the upper section of the well with cement.

As we can see, we can position the servicing string of pipe below the pay zone. AU these solutions are effective to plug the well. It will be up to engineering to select what they think it may be more appropriated. On the other hand, using at least a grid, a servicing string of pipe and some plugging material, engineering can come out with another way that may be equally effective.

2. Placing a Grid in the Wellhead

We can set a grid or a mess that is resistant enough to catch the matrix material that will form the filter. The grid should have as a base a flange. The flange can be attached to the flange in the top of the blow out preventers or to the one where the blows out preventers are attached to the well. One example of such a grid could be like a bird cage, but with an opening in the top to allow the servicing string of pipe to pass through it. In this bird cage, the grid lines do not meet in the top of the center of the cage. Rather than that, they flow in a continue way from one side of the flange to the other side of the flange. Parallel to the plane of the flange, should be concentric lines that hold together the lines that are attached to the flange.

We can lower the servicing string of pipe through the grid. After we have positioned the servicing string of pipe to the planned depth, we start pumping from the surface in order to deploy the filtering material. It is better to try to place the bottom of the servicing string of pipe near to the bottom of the well. We can apply the same rules I mentioned before. If we want to try to recover the string of pipe, spheres are the best shape. However, there is no guarantee that the servicing string pipe will come out of the hole once the filter is set.

Figure 8:
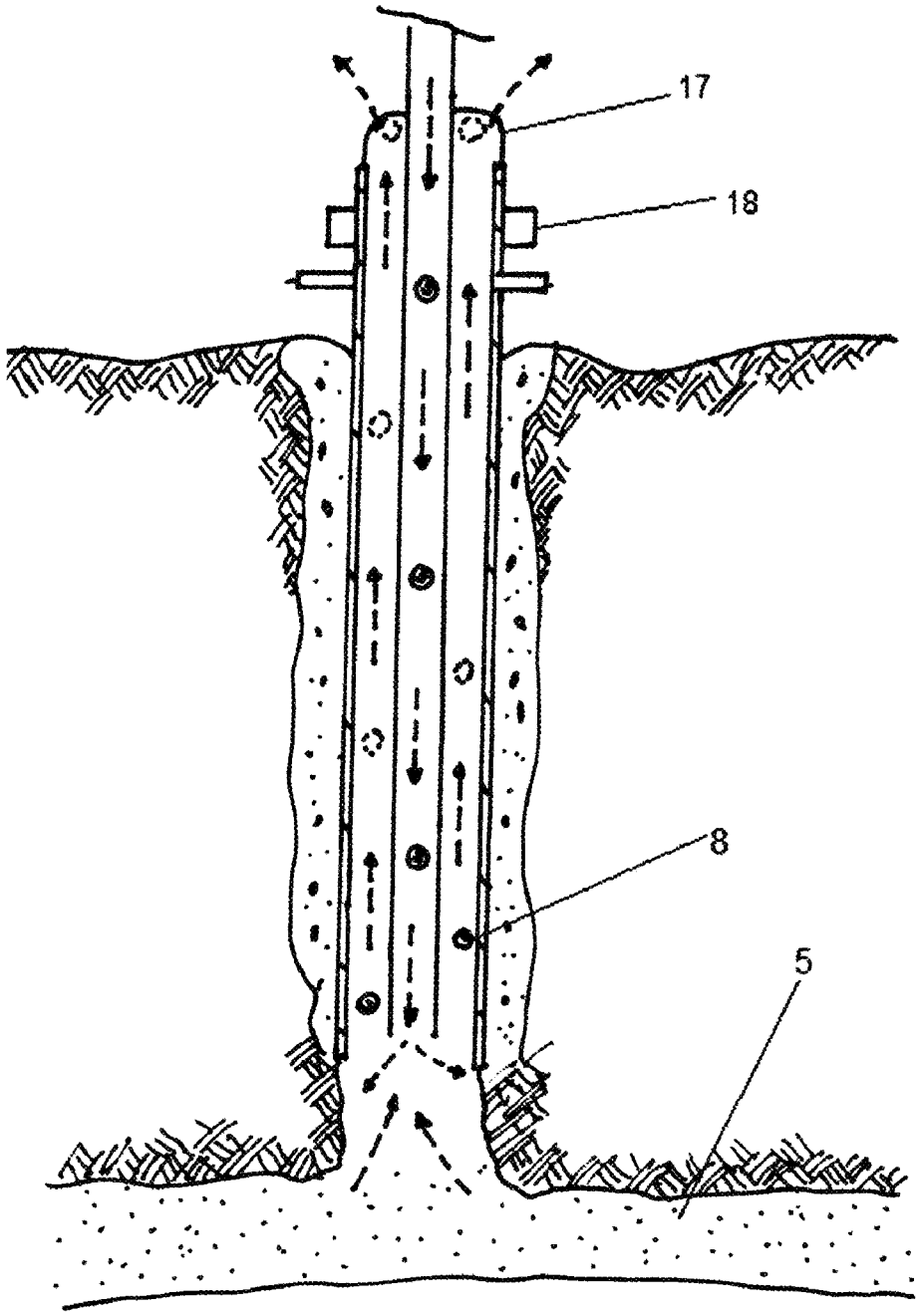
FIG. 8 is an elevational view of an oil/gas well where balls are being deployed through the servicing string of pipe. Once the balls reach the bottom they are taken up by the downhole fluids. A grid that is attached to the top of the BOPs avoids the balls to come out of the well.

We can use a gel fluid in order to facilitate the spacing between the balls, assuming that it is the shape that we have decided to use. Once the filtering material reaches the bottom of the servicing pipe, the underneath pressure will carry it through the annulus between the servicing string of pipe used to deploy the material to build the filter and the casing. To facilitate this discussion, I am assuming that we are pumping balls. See FIG. 8, where balls 8 are deployed, formation fluids are coming out the pay zone 5, and they take the balls up to the grid 17. The formation fluids are coming out passing the upper grid. The BOPs 18 are opened.

If we want to make sure that we have the desired length for the filter, we can use material with light density; or, we can reduce the size of the material as we build the filter. We can also use the combination of materials with different densities.

In addition, if we want to have an even distribution of the filtering material, we can place centralizers on the servicing string pipe. If we use centralizers, we will be unable to recover the servicing string of pipe.

Figure 9:
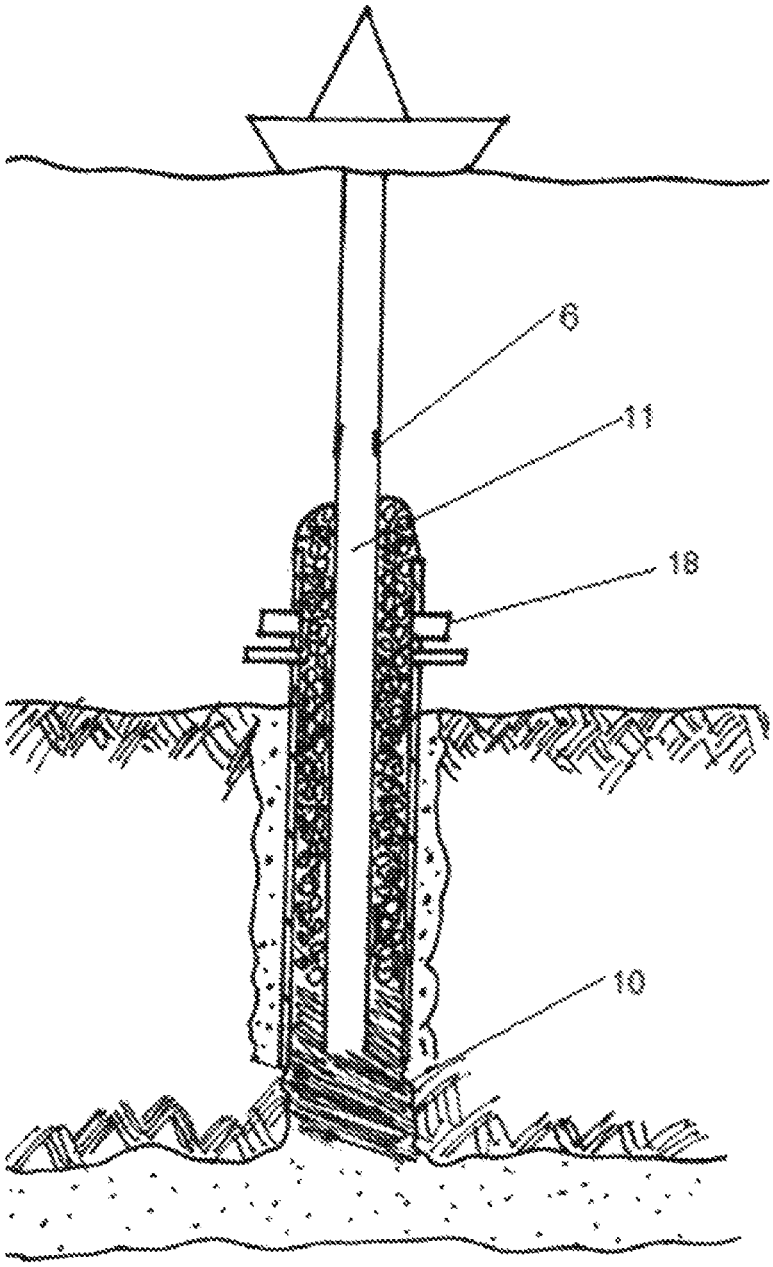
FIG. 9 is an elevational view of an oil/gas well where the porous area of the filter and the bottom of the oil/gas well has being filled out with synthetic sorbents.

We have different options to plug the well once the filter is built. I will just mention a couple. In the first one, we can pump synthetic sorbents using the servicing pipe. The synthetic sorbents used should be the ones that swell in contact with oil. Once this material reaches the bottom of the servicing string of pipe, the downhole pressure will push it through the tortuosity of the pores of the balls, or the geometrical shaped we decided to use to build the filter. We can pump enough of this material to plug the section below the servicing string of pipe and the porous area in the matrix. When the displacement fluid is in the end of the servicing string of pipe, we hold the pressure inside the servicing string of pipe. In time, the synthetic sorbents will swell sealing everything around it. Once this is achieved, we can detach the servicing string of pipe from the joint that is above the grid. After this, we can go inside the servicing string of pipe using coiled tubing and start to pump cement to plug it. In FIG. 9, we can see that the bottom of the well as well as the annular side is plugged with synthetic sorbents 10, inside the servicing string of pipe there is some displacement fluid 11. Above the grid there is a detachable joint 6. The BOPs 18 are open. This operation implies that the servicing pipe will stay in the well.

Figure 10:
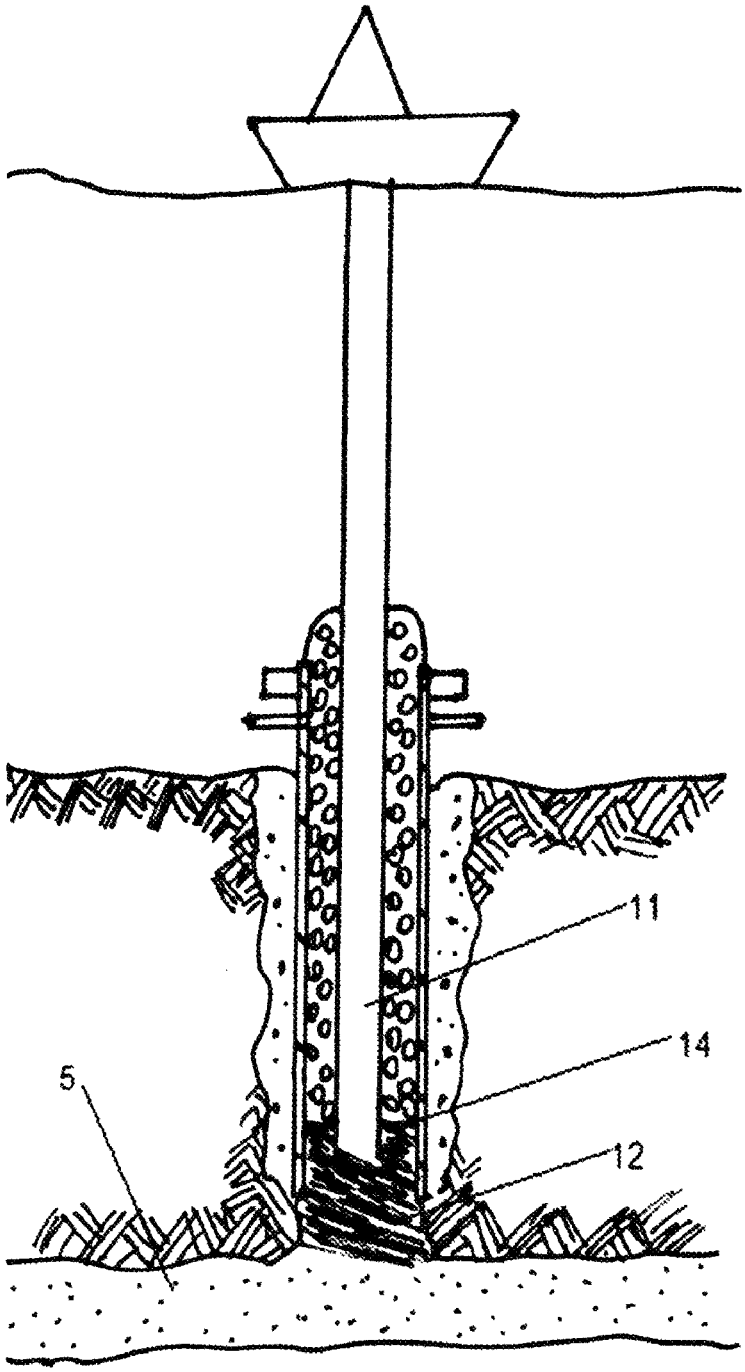
FIG. 10 is an elevational view of an oil/gas well where underneath the bottom of the filter matrix there is a layer of impermeable material which avoids formation fluids to go through the annular side. There is a plug of cement underneath the servicing string of pipe. Inside of the bottom of the servicing string of pipe there is some displacement fluid.
Figure 11:
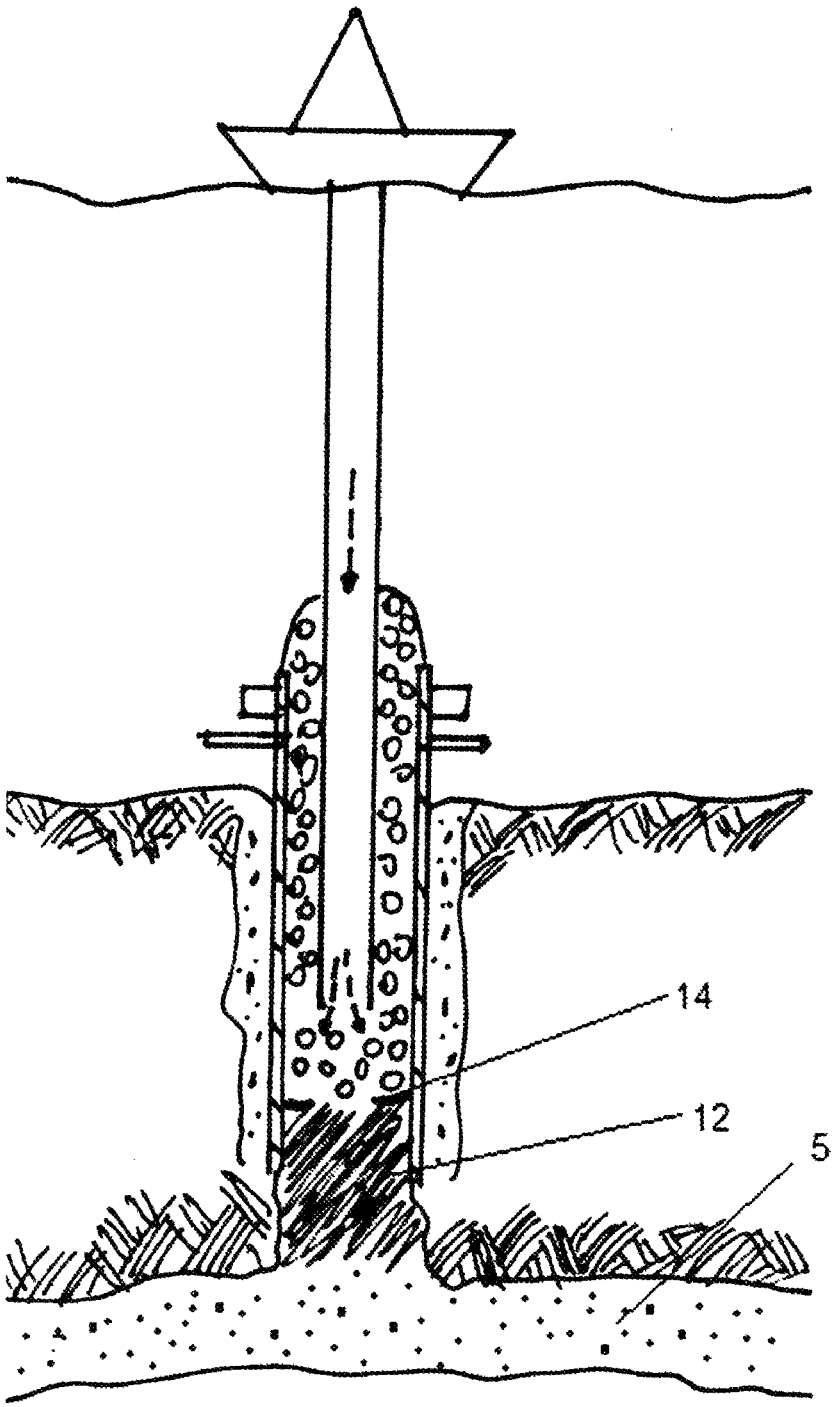
FIG. 11 is an elevational view of an oil/gas well where the servicing string of pipe is being lifted. As it is being lifted, cement is being pumped out.

A second method to plug the well consists in pumping a good batch of plastic or impermeable material to plug the bottom of the filter matrix. After the batch of plastic, we can pump enough cement 12 to plug the bottom of the well. See FIG. 10. The displacement fluid 11 should be at the end of the servicing string of pipe. We hold the pressure and wait for the cement to get hard. The pay zone 5 is being sealed by a plug of cement 12. The plug of cement is held in place by an impermeable layer 14 and by some displacement fluid. The volume of how much cement has to be pumped is the volume from the bottom of the impermeable material to the bottom of the well. After the batch of cement there should be a displacing fluid making sure that cement will be out of the servicing pipe. Once the displacement fluid reaches the bottom of the servicing pipe, we shut down the pumps and hold the pressure. At this point, below the servicing pipe there should be a plug of cement. The cement cannot go to the porous of the matrix because a layer of impermeable material 14 avoids it. The next step is to wait for the cement to harden. Once the cement is hard, we can try to pull out the servicing pipe. If we are successful, we can pump cement as we pull out the servicing pipe to plug the porous part of the filter and the space left by the servicing pipe. See FIG. 11 where some cement 12 avoids the fluids from the pay zone 5 to come out. As we lift the servicing string of pipe we pump cement.

If we are unable to pull out the servicing pipe, we go down with slickline and open the sliding sleeve that is located near the bottom of the servicing string of pipe. After this, we start to pump enough cement to plug the porous area of the matrix. After the well is plugged, we can detach the servicing pipe, remove the cage, and place a cap on the top of the well.

There are many ways to plug the well using some basic tools like a grid, some matrix component and some plugging material. I have also showed how to use some sliding sleeves, some perforated joints and detachable joints. There are many ways that could be used to plug the well using some of the tools I showed. I cannot go over every single way of how to use those tools to plug a leaking oil/gas well. Now, it is up to the imagination of the engineer of how to use this method in a way that best matches their situation for the oil/gas well that is leaking.

Making the service string of pipe can take 5 days. Deploying the filtering material and plugging the well may take about 6 more days. So in about 2 weeks, the problem can be solved.

REFERENCE NUMERALS

1. Valve
2. Perforated Joint
3. Sliding Sleeve
4. Ocean Floor
5. Pay Zone
6. Detachable Joint
7. Integrated Grid
8. Matrix Component (ball)
9. Casing
10. Synthetic Sorbents
11. Displacement Fluid
12. Cement
13. Semi Perforated Joint
14. Impermeable Material
15. Near Bottom Sliding Sleeve
16. Near Bottom Perforated Joint
17. Grid
18. Blow Out Preventers (BOPs)

What I claim as my invention is:

1. A method to shut down a high pressure oil/gas well that is leaking under blowout conditions, said method comprising:

making a servicing string of pipe to be ran in the oil/gas well that is leaking which is composed of at least a valve, a perforated joint and a sliding sleeve;

wherein in order to assemble more joints in the servicing string of pipe the valve should be in a closed position and the sliding sleeve should be in an open position, so fluids can escape through the perforated joint making it possible to assembly the servicing string of pipe by reducing the amount of pressure which is trapped in the servicing string of pipe and reducing the chances for the servicing string of pipe to come out of the well due to the high downhole pressure;

wherein the valve should be in the open position and the sliding sleeve should be in the closed position when the valve and the sliding sleeve are near the wellhead, so, they can be ran into the oil/gas well;

building a filter which may have a grid placed anywhere in the oil/gas well, said grid should be located in the wellhead in order to guarantee that the servicing string of pipe will not be pushed out of the oil/gas well due to the high downhole pressure producing a disaster in a surface vessel where the operations are effectuated;

wherein as the grid is placed downhole, the greater the downhole pressure, the greater the chance for the operation to fail;

pumping a filter matrix through the servicing string of pipe where the matrix can be of any material with any geometry, said geometry should be in the shape of a ball, said ball density, size and roughness can be changed, for said filter steel balls should be used first, said balls are as big as it could be possible where the balls will be able to go up through the annular side of the servicing string of pipe and the casing or open hole;

wherein the filter matrix should have a length calculated by the equation:

$$I=p/0.052*\delta$$

where:

I is the minimum length of the filter in feet, p is the downhole pressure in psi, and δ is the average density of the composed material that is forming the matrix in pounds per gallon.

2. The method of claim 1, wherein a new valve, a perforated joint and a sliding sleeve are placed in the upper section of the servicing string of pipe each time that the previous valve, the perforated joint and the sliding sleeve are near the wellhead, so a length of servicing string of pipe of about the distance from the wellhead to the surface vessel can be made in order to be ran into the oil/gas well.

3. The method of claim 1, wherein the filer is plugged by pumping big chunks of polymers that swell in contact with oil or water, where some of the chunks will be cured in the porous of the said matrix; pumping cement after the polymers have expanded to finish plugging the well.

4. The method of claim 1, wherein before building the filter a semi perforated joint was installed near to the lowest place in the servicing string of pipe;

pumping a batch of impermeable material followed by displacement fluid where the said impermeable material will plug the bottom of the said matrix, for instance, the said impermeable material could be plastic bags; when the bottom of the said matrix is plugged from below, the downhole fluid force will not push out the said plug due that the weight of the said matrix should be about equal to the downhole force; as the pumping continues, the holes in the said semi perforated joint will pop up due to a differential pressure that is created, and at this point, cement is pumped in order to plug the bottom of the well and the porosity of the said filter.

5. The method of claim 1, wherein before building the filter a semi perforated joint was installed near to the lowest place in the servicing string of pipe;

pumping a batch of impermeable material followed by displacement fluid where the said impermeable material will plug the bottom of the said matrix, for instance, the said impermeable material could be plastic bags; as the pumping continues, the holes in the said semi perforated joint will pop up due to a differential pressure that is created, and at this point, a volume of polymers that expand in contact with oil is pumped followed by a displacement fluid, where in the said volume of polymers is equal to the volume from just below the said semi perforated joint to the bottom of the said well, pumping after the volume of the said polymer enough cement to plug the porous section of the said matrix and the rest of the well.

* * * * *